United States Patent [19]

McKnight

[11] Patent Number: 4,648,638

[45] Date of Patent: Mar. 10, 1987

[54] SLIDING DOOR LOCK ASSEMBLY

[76] Inventor: Roy S. McKnight, P.O. Box 116, Dundee, Fla. 33838

[21] Appl. No.: 747,834

[22] Filed: Jun. 24, 1985

[51] Int. Cl.[4] ..... E05C 1/08

[52] U.S. Cl. ..... 292/144; 70/100; 70/279; 292/150; 292/165; 292/170; 292/179; 292/182; 292/DIG. 46

[58] Field of Search ..... 292/144, 170, 179, 182, 292/165, 150, 169, DIG. 46, 137, 163, 164, DIG. 15; 70/90, 95, DIG. 80, 99, 100, 277, 279, 282

[56] References Cited

U.S. PATENT DOCUMENTS

| | | | |
|---|---|---|---|
| 1,601,024 | 9/1926 | Jacobson | 292/144 X |
| 2,466,481 | 4/1949 | Royal | 292/144 |
| 2,517,378 | 8/1950 | Aspenwall et al. | 292/170 |
| 2,765,648 | 10/1956 | Hatcher . | |
| 2,973,984 | 3/1961 | Burke | 292/182 |
| 3,082,617 | 3/1963 | Kerman . | |
| 3,768,847 | 10/1973 | Buck, Jr. et al. . | |
| 3,828,592 | 8/1974 | Horgan | 292/170 X |
| 3,950,018 | 4/1976 | Pickering . | |
| 4,141,610 | 2/1979 | Ando . | |
| 4,248,461 | 2/1981 | Stevens . | |

FOREIGN PATENT DOCUMENTS

| | | | |
|---|---|---|---|
| 10446 | 1/1903 | Austria | 292/144 |
| 1208974 | 9/1959 | France | 292/144 |
| 14695 | of 1885 | United Kingdom | 292/170 |
| 15284 | of 1898 | United Kingdom | 292/92 |

*Primary Examiner*—Robert L. Wolfe
*Assistant Examiner*—Lloyd A. Gall
*Attorney, Agent, or Firm*—King & Schickli

[57] ABSTRACT

A lock assembly for a sliding closure has a bolt movable into and out of the path of the closure by a movable plate. A cam surface on the plate retracts the bolt from the path of the closure. A first spring moves the bolt into the path of the closure as the plate is moved by a pivoting reset lever engaging a tab on the plate. The plate is urged in the opposite direction by a second spring. A locking aperture on the plate and a solenoid with an armature engaging the aperture are provided for locking the plate in position at the limit of its travel to hold the bolt in the path of the closure. The solenoid is operated by either an inside or outside switch to release the plate and disengage the bolt. Alternatively, a plunger on the housing can be pushed to manually disengage the armature.

8 Claims, 6 Drawing Figures

SLIDING DOOR LOCK ASSEMBLY

BACKGROUND OF THE INVENTION

This invention relates to power locks for sliding doors and the like, and more particularly, to a power operated lock assembly utilizing a reciprocal bolt for movement into and out of the path of movement of the door.

Sliding doors are very popular for all types of homes. In the modern home, it is not uncommon to find two or more sliding doors, especially in living areas of the home, such as opening onto a porch, patio, balcony or carport. A sliding door provides many advantages including ease of operation, large glazing areas for admission of light into the home and a wide passage for ease of entry and exit through the doorway.

The only shortcoming of sliding doors that has kept the door from being even more popular than it is, is the matter of security when locked. In the past, the sliding door has been subject to criticism from security officers for the lack of security locking means. In an attempt to fill the gap, various make-shift arrangements have been provided by homeowners, such as a wooden stick laying in the track of the door to jam the door against movement toward the open position. However, such an arrangement is very inconvenient and generally unsightly. The stick is prone to be misplaced while the door is open and provides a particular hazard for small children who will play with the stick. When the stick is removed, the door is left open and subject to unauthorized entry. Sliding door manufacturers do provide a lock at the forward jamb of the door, but the lock is very fragile and can be easily broken by insertion of a crow bar or other prying tool. The lock is also usually positioned by the manufacturer very close to the jamb so that operation of the lock is difficult without hitting the knuckles against the sharp edges of the door jamb.

Also, although power operated doors and windows have been in use for several years, insofar as I am aware, there has not been a power operated lock suitable for a sliding door. Locks adapted for automobile doors and other types of swinging doors are simply not adaptable to a sliding door arrangement where special problems of positioning of the components, strength required and ease of operation are present. For this reason, new locks in the field have been limited to purely mechanical locks of the type requiring direct engagement with the components of the lock in order to operate it. The mechanical locks are not adapted for remote control and thus do not provide convenience for the homeowner. Two typical prior lock arrangements are shown in the patents to Buck et al. U.S. Pat. No. 3,768,847 (a simple sliding bolt utilized with a manually operated mechanical release button required to be pushed to unlock the door) and the Stevens U.S. Pat. No. 4,248,461 (a manually operated pivoting lever having a plurality of notches for engagement with a plate).

Another manually operable bolt lock (similar to the Buck U.S. Pat. No. '847) is shown in U.S. Pat. No. 3,082,617 to Kerman. A key-actuated closure lock has a bolt which enters a recess in the closure sash to prevent movement of the sash. This lock cannot be actuated from outside the closure.

U.S. Pat. No. 3,950,018 to Pickering discloses a very complicated locking device for railway freight car or other freight vehicle doors. The lock, which is built into the freight car door, is provided with a movable bolt which enters a recess in the doorway to prevent opening of the door. The lock may be opened by the use of compressed gas, by a solenoid or by the use of a key used in conjunction with the compressed gas. This massive lock, which is built into the heavy freight car door, cannot be used with a door such as a sliding glass door.

U.S. Pat. No. 4,141,610 to Ando discloses a showcase lock wherein the armature of a solenoid extends into a recess in the glass showcase door to lock this door whenever it is in the closed position. Unless the solenoids are continuously energized, the doors will be locked at all times when the doors are closed. This would be totally unsuitable for use, for example, with a sliding glass door opening onto a patio or deck.

U.S. Pat. No. 2,765,648 to Hatcher discloses an electro-magnetic vehicle door lock actuated by two solenoids. One of the solenoids is energized to unlock the door and the other is energized to lock the door. The structure of this lock is unsuitable for a sliding glass door and the use of two solenoids requires an unduly complicated control circuit.

Thus, the need is present for an effective power operated lock for a sliding closure, such as a sliding door for a home.

With this in mind, it is an object of this invention to provide a power operated lock for a sliding door which overcomes the problems present in known locks.

It is another object of this invention to provide a power operated lock for a sliding door which can be operated for opening from either the inside or outside and which can also be manually operated.

It is a still further object of this invention to provide a power lock which is simple in construction and inexpensive to manufacture, yet has exceptional strength so that the door cannot be pried open.

It is still another object of the present invention to provide a power door lock assembly with power operation and including cooperative parts that are easy to engage to, provide the locking and unlocking functions.

Still another object of this invention is to provide a power operated lock that is easy to set and includes visual indicating means allowing the user to determine at a glance whether the lock is set in a locked condition.

Additional objects, advantages and other novel features of the invention will be set forth in part in the description that follows and in part will become apparent to those skilled in the art upon examination of the following, or may be learned with practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention as described herein, a lock assembly is provided having a reciprocal bolt mounted in a stationary housing adjacent the sliding closure, such as a sliding door. The bolt is positioned for movement into and out of the path of the door. A member slidably mounted in the housing is provided with a cam surface in engagement with the bolt; the cam surface being such that when the member is in a first position, the bolt is retracted from the path of the door and when the member is in a second position, the bolt extends into the path of the door. Means are provided for locking the member in the second position to retain the bolt in the path of the door when it is desired that the door be locked.

In the preferred embodiment, the slide member takes the form of a plate mounted on a support bracket in the housing. Bent-up wings guide the plate and include support apertures for the bolt. A camming aperture on the sliding plate provides the cam surface engaging an operator pin on the bolt. A spring biased armature on the power solenoid engaging a locking aperture on the plate forms the locking means. A manually operable plunger aligned with the armature allows release, and thus unlocking action by pushing of the armature from the locking aperture.

A pivotal reset lever engages an upstanding tab on the plate to allow locking of the lock assembly. The end of the bolt includes a roller to engage the frame of the door if the lock assembly is set prior to closing the door. Once the full closed position is reached, the bolt snaps into the locked position in the path of movement, such as behind the rear edge of the frame.

Still other objects of the present invention will become readily apparent to those skilled in this art from the following description wherein there is shown and described the preferred embodiment of this invention, simply by way of illustration of one of the best modes contemplated for carrying out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Figure 1:
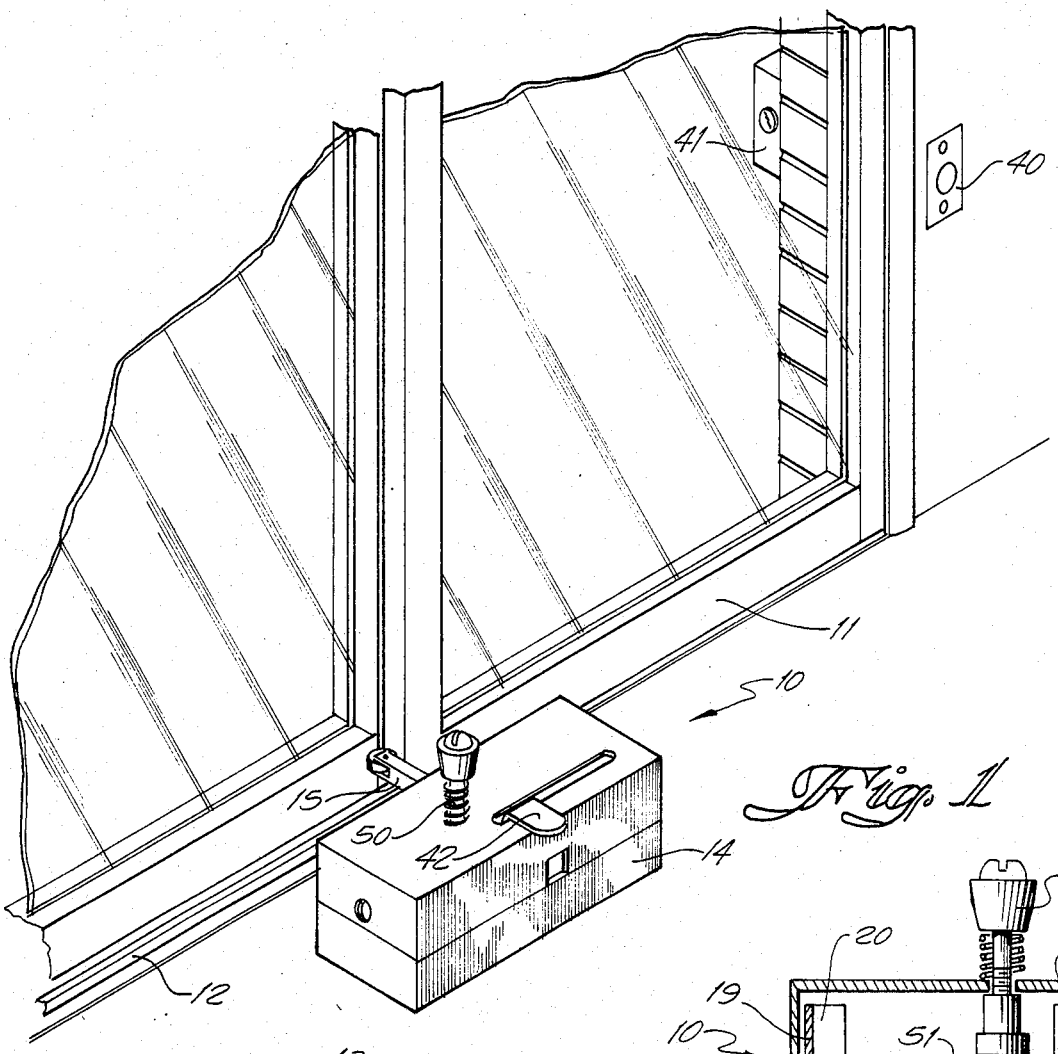
FIG. 1 is a perspective view showing the lock assembly of this invention mounted adjacent to a sliding glass door.
Figure 5:
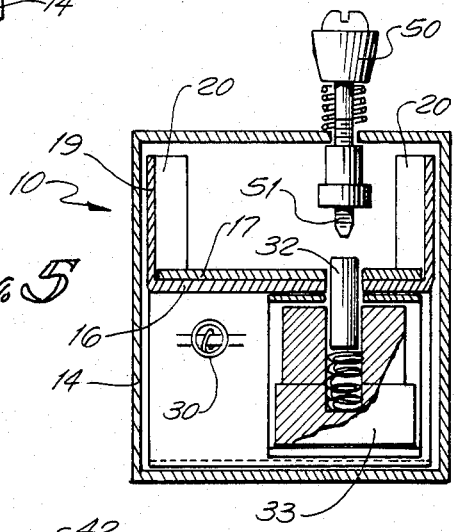
FIG. 5 is a cross sectional view taken on line 5—5 of FIG. 3 showing a spring loaded plunger used to push the solenoid armature downward to manually unlock the lock.

Reference will now be made in detail to the present preferred embodiment of the invention, an example of which is illustrated in the accompanying drawings.

DETAILED DESCRIPTION OF THE INVENTION

Referring now in detail to the drawings, there is shown a lock assembly 10 mounted adjacent to a sliding glass door 11 which is movable on a track 12 between open and closed positions. The lock 10 is provided with a housing 14 which supports a bolt 15 for movement along a path into and out of the path of the door 11. It will readily be apparent that, when the bolt 15 extends into the path of the door 11, and more particularly, behind the frame when the door is fully closed, the door 11 cannot be opened.

The lock 10 rests on a floor 13 adjacent to the door 11 and is securely attached to the floor by heavy screws 18. With the lock so mounted, the sturdiness of the bolt 15 makes it impossible to pry the door 11 open.

Figure 3:
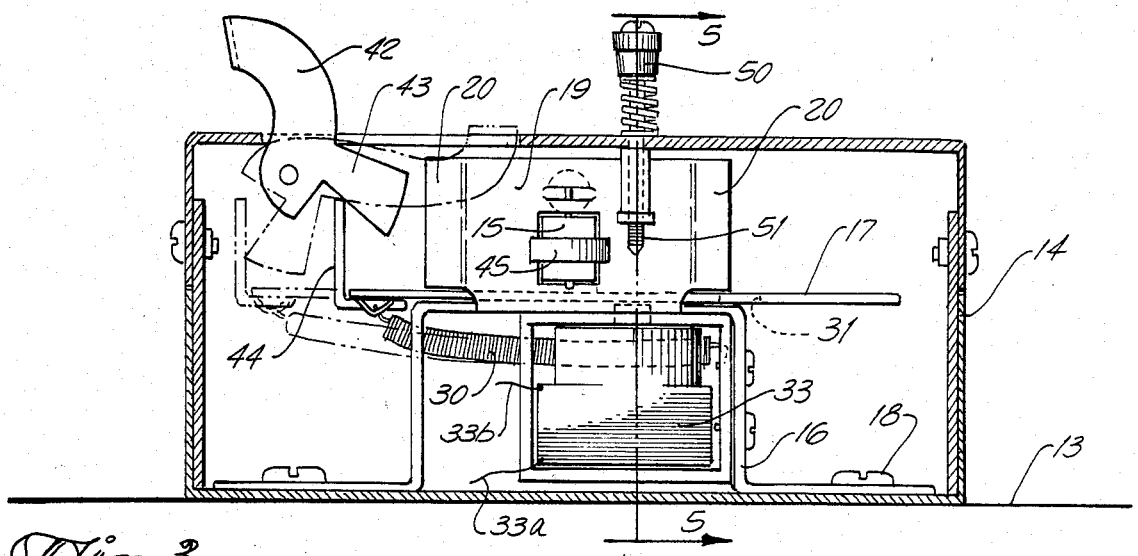
FIG. 3 is a slightly enlarged side view with the side of the lock assembly cut away to show the relationship of the various parts.
Figure 4:
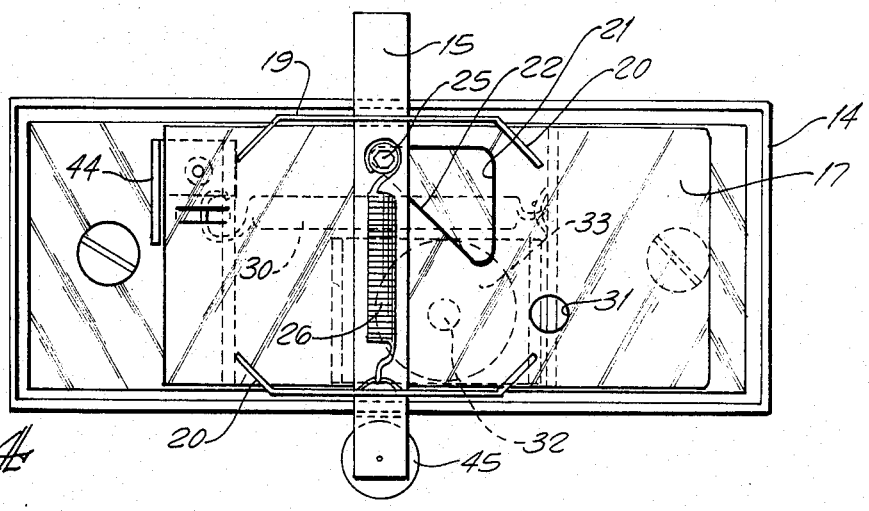
FIG. 4 is a plan view of the lock assembly with the top of the housing cut away to show the positioning of the cam plate and bolt when in an unlocked condition.

A bracket 16 (best shown in FIG. 3) secured to the housing 14 supports a cam plate or member 17. Wings 19 of the bracket 16 extend upward past the cam plate 17 and are provided with angled extensions 20, the angled extensions 20 extending outwardly over the plate 17, in such a manner that the plate 17 is free to slide back and forth between the bottom edges of the angled extensions 20 and the upper surface of the bracket 16. As shown in FIGS. 3 and 4, wings 19 of the bracket 16 have aligned apertures for receipt of the bolt 15.

The plate 17 is provided with a camming aperture 21 having a 45° edge surface 22 which serves as a cam. A pin 25 secured to the bolt 15 extends through the aperture 21. Preferably, the camming aperture forms a substantially right triangle with the camming surface forming the hypotenuse. The pin 25 is free to move within the triangular aperture 21 to allow partial movement of the bolt 15 toward said second position upon engagement with the closure door 11 in the open position. A spring 26 connected between the housing 14 and the pin 25 serves to pull the pin 25 into engagement with the cam surface 22. When the plate 17 is moved into the position shown in FIG. 4, the cam surface 22 moves the pin 25 against the action of the spring 26 to retract the bolt 15 from the path of the door 11 to allow the door to be opened and the lock to be reset. When the plate 17 is moved to the position shown in FIG. 4A, the pin 25 rides down the cam surface 22 under the action of the spring 26, and moves the end of the bolt 15 into the path of the door 11 to prevent opening of the door.

A tension spring 30 connected between the plate 17 and the bracket 16 urges the plate 17 into the position shown in FIG. 4 to retract the bolt 15 and thereby free the door 11. In order to retain the plate 17 in the position shown in FIG. 4A to prevent the door 11 from being opened, the plate 17 is provided with a locking aperture 31 positioned to be in alignment with the armature 32 of a solenoid 33 mounted on the bracket 16. Thus, when the plate 17 is moved to the position shown in FIG. 4A, the spring-biased armature 32 of the solenoid 33 enters the locking aperture 31 in the plate 17 to prevent movement of this plate, and thereby retain the bolt 15 in the path of the door 11.

To energize the solenoid 33 and withdraw the armature 32 from the aperture 31, the homeowner presses a pushbutton switch 40 mounted on a wall near the door 11 or a key-operated switch 41 mounted outside the door 11. A standard electrical circuit (not shown) provides current through the leads **33*a*, 33*b* and thus draws the armature 32 downwardly, releasing the plate 17. This allows the tension spring 30 to move the plate 17 into the position shown in FIG. 4** to thereby unlock the door.

Figure 4A:
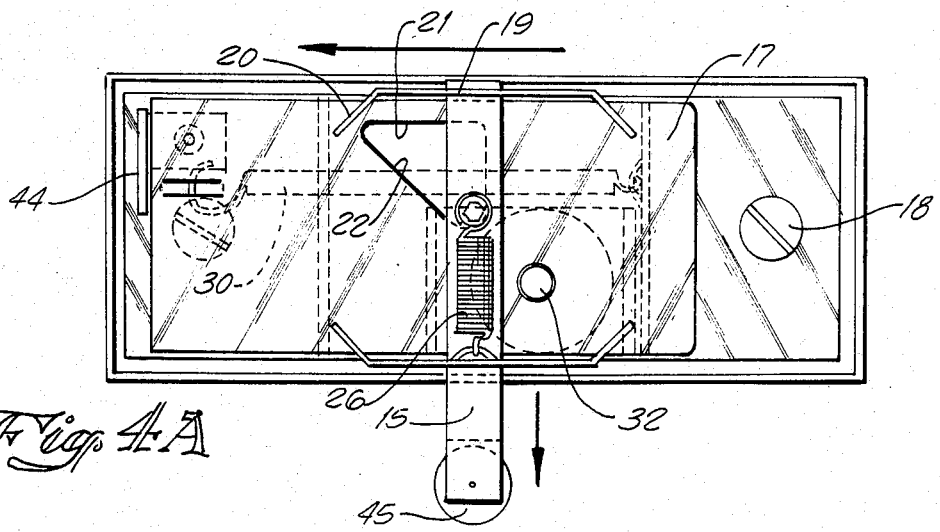
FIG. 4A is a view of FIG. 4 showing the positioning of the cam plate and the bolt when the bolt extends into the path of the door for locking.

A reset level 42 pivotally mounted on the housing 14 is provided with a finger 43 which engages a tab 44 on the plate 17 to move this plate into the position shown in FIG. 4A when the lever 42 is depressed. In this condition, the bolt 15 extends into the path of the door 11 so that the door 11 cannot be opened. It will be readily apparent that, when the solenoid 33 is energized to allow the tension spring 30 to move the plate 17 to the position shown in FIG. 3, the tab 44 moves the finger 43 to raise the lever 42.

Figure 2:
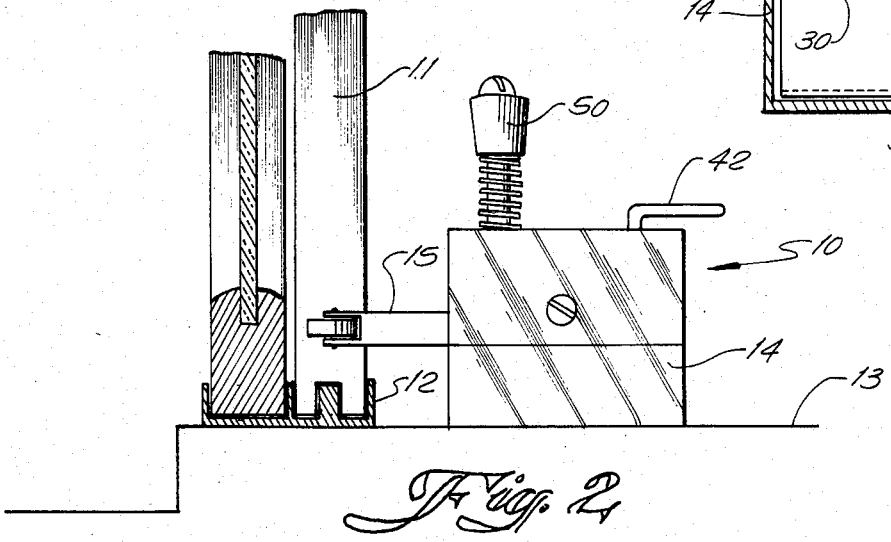
FIG. 2 is an end view of the lock assembly showing the manner in which the bolt extends into the path of the door.

While the lever 42 serves to reset the lock to the locked condition, it also serves as a visual indicator of the status of the lock. The homeowner can determine, at a glance and from a distance, whether the lock is in a locked status. If the lever 42 is in a raised position, the door 11 is unlocked. If the lever 42 is in the lowered position, as shown in FIGS. 1 and 2, the door 11 is locked.

The bolt 15 is provided with a roller 45 which extends beyond the end of the bolt. The use of the roller 45 enables the homeowner to set the lock to the locked condition when the door 11 is in an open or partially open position. With the door 11 open or partially opened, the homeowner depresses the lever 42 to set the lock to the locked condition. This moves the plate 17 into the position shown in FIG. 4A and allows the spring 26 to move the bolt 15 toward the door until the roller 45 engages the surface of the door. The homeowner may then exit the door and pull it closed behind him. As the door 11 is moved toward the closed position, the roller 45 rolls across the surface of the frame of the door 11 until the door is fully closed. At that time, the spring 26 snaps the bolt 15 into the position shown in FIGS. 1 and 2, thereby locking the door.

While the lock assembly can be unlocked by operation of either of the switches 40 or 41 to energize the solenoid 33, it is also possible to unlock the lock manually. This is done by depressing a spring-loaded plunger 50 mounted on the housing above the armature 32 of the solenoid 33. The plunger 50 is provided with a pin 51 for pushing the armature 32 downward and out of the locking aperture 31, thereby allowing the spring 30 to move the plate 17. The edge of the aperture 31 kicks the pin 51 as the plate 17 is released and the plunger 50 is retracted. The plate 17 is now in the position shown in FIG. 4 to retract the bolt 15 from the path of the door 11 and allow opening movement.

In operation, the homeowner first depresses the lever 42 to move the plate 17 into the reset position shown in FIG. 4A. This moves the bolt 15 into the path of the door 11. When it is desired to open the door 11, the homeowner actuates either of the switches 40 or 41, or depresses the plunger 50. This removes the armature 32 from the locking aperture 31 in the plate 17 and allows the spring 30 to move the plate 17 to the position shown in FIG. 4. This retracts the bolt 15 from the path of the door 11 so that the door may now be opened.

From the above description, it can be seen that numerous improved results and advantages can be obtained with this new lock assembly 10. The structure is simple and of low cost, as well as being easy to operate. It will be readily apparent that this lock assembly 10 can be manually locked and unlocked by simply touching the foot on the plunger 50 and lever 42, respectively, without bending or stooping. Unlocking is however normally power controlled through either of the switches 40, 41.

The sliding plate 17 has an edge surface 22 within aperture 21 and the spring 26 that cams the bolt 15 to the correct position. The aperture 21 is triangular to allow partial movement of the bolt 15 toward the locked position upon release. The roller 45 on the bolt 15 engages the frame until snapping into position (see FIG. 1) in the fully closed position.

The locking aperture 31 in the plate 17 overlies the spring biased armature 32 providing the highly desired secure locking action needed. The bolt 15 and the plate 17 both are securely positioned by the wings of bracket 16.

The entire assembly 10 including housing 14 is strong and rugged to give maximum security to the sliding closure. The lock assembly is positioned at the side of the door opening so as not to restrict in any way passage through the door. The housing of the assembly 10 can be of aluminum so as to blend well with the aluminum finish of the door 11 and the profile of the lock assembly 10 easily allows the curtains at the door to pass over and around the same without difficulty. When the curtain is pulled, the lock assembly 10 is in fact barely visible.

The foregoing description of the preferred embodiment of the invention is presented for purposes of illustration and description. It is not intended to be exhaustive or to limit the invention to the precise form disclosed. Obvious modifications and variations are possible in light of the above teachings. For example, in addition to operating the outside switch 41 by a key, cipher device or remote control, a switch may be directly interconnected with an automatic garage door opener. Similarly, both switches 40, 41 may also disarm a burglar alarm simultaneously to avoid the possibility of sounding the alarm by mistake. While the preferred embodiment has been shown with respect to a sliding door, it is clear that other closures, such as windows, sliding showcase doors or the like can be equally well served by the concepts of my invention.

With the above in mind, it is clear the present embodiment was chosen and described simply to provide the best illustration of the principles of the invention and its practical application in order to enable one of ordinary skill in the art to utilize the concepts of the invention in various embodiments and with various modifications as are suited to the particular use contemplated. Also, such modifications and variations are deemed to be within the scope of the invention as determined by the appended claims when interpreted in accordance with the breadth to which they are fairly, legally and equitably entitled.

I claim:

1. A lock assembly for a closure mounted for sliding movement back and forth along a path from a closed position to an open position, comprising:

a lock housing mounted adjacent to the closure;

a bolt mounted on the housing for sliding movement between a first position retracted from the path of the closure and a second position where a portion of the bolt extends into the path of said closure;

a plate movably mounted on the housing and having therein a camming aperture providing a cam surface;

a pin secured to the bolt and extending through the aperture in the plate;

a first spring connected between the housing and the pin for urging the bolt toward the path of the closure to bring the pin into contact with the cam surface, said cam surface having a configuration such that movement of the plate in one direction allows the bolt to move toward the path of the closure and the movement of the plate in the other direction cams the bolt toward the retracted position;

a second spring connected between the housing and the plate for urging said plate in said other direction; and reset means for moving said plate in said one direction to position the bolt in the path of movement of the door for locking.

2. The lock assembly of claim 1 wherein said reset means includes a pivotal lever on said housing and a tab on said plate engaged by the lever.

3. The lock assembly of claim 2 wherein said pivoted lever extends outwardly from said housing when the bolt is in said first position, whereby visual indication of the lock assembly being unlocked is provided.

4. The lock assembly of claim 1 wherein said lock assembly is power operated and is provided with a locking aperture on said plate, a solenoid on said housing with an armature positioned to extend into the aperture of the plate at the end of movement of the plate in said one direction and means to operate said solenoid.

5. The lock assembly of claim 4 further including a spring loaded plunger mounted on the housing for forcing the armature out of the locking aperture to free the plate for movement by the second spring.

6. The lock assembly of claim 1 further including a bracket for mounting said plate, and having a guide surface for one side of the plate, a pair of wings extending from said surface for lateral guiding of said plate and angled portions on the wings with the edges guiding the plate on the other side.

7. The lock assembly of claim 6 wherein said bolt is carried for reciprocal movement in aligned apertures extending through said wings.

8. The lock assembly of claim 1 wherein said camming aperture forms a substantially right triangle, said camming surface forming the hypotenuse, said pin being free to move within the triangular aperture to allow partial movement of the bolt toward said second position upon engagement with the closure in the open position.

* * * * *